US010252730B2

(12) United States Patent
Huck

(10) Patent No.: US 10,252,730 B2
(45) Date of Patent: Apr. 9, 2019

(54) RAILCAR WITH PROGRESSIVE OPENING LONGITUDINAL GATES

(71) Applicant: Trinity North American Freight Car, Inc., Dallas, TX (US)

(72) Inventor: Kenneth W. Huck, Fairview, TX (US)

(73) Assignee: Trinity North American Freight Car, Inc., Dallas, TX (US)

( * ) Notice: Subject to any disclaimer, the term of this patent is extended or adjusted under 35 U.S.C. 154(b) by 255 days.

(21) Appl. No.: 15/406,413

(22) Filed: Jan. 13, 2017

(65) Prior Publication Data

US 2018/0201279 A1 Jul. 19, 2018

(51) Int. Cl.
*B61D 7/28* (2006.01)
*B61D 7/02* (2006.01)

(52) U.S. Cl.
CPC *B61D 7/28* (2013.01); *B61D 7/02* (2013.01)

(58) Field of Classification Search
CPC ... B61D 7/00; B61D 7/02; B61D 7/04; B61D 7/06; B61D 7/18; B61D 7/26; B61D 7/28
See application file for complete search history.

(56) References Cited

U.S. PATENT DOCUMENTS

| | | | | |
|---|---|---|---|---|
| 3,581,672 | A * | 6/1971 | Aquino | B61D 7/28 105/240 |
| 2007/0084378 | A1* | 4/2007 | Creighton | B61D 7/02 105/247 |
| 2010/0275811 | A1* | 11/2010 | Creighton | B61D 7/24 105/307 |
| 2012/0118195 | A1* | 5/2012 | Creighton | B61D 7/00 105/377.06 |
| 2015/0096459 | A1* | 4/2015 | Sandheinrich | B61D 7/26 105/286 |

* cited by examiner

*Primary Examiner* — Robert J McCarry, Jr.
(74) *Attorney, Agent, or Firm* — Baker Botts, LLP

(57) ABSTRACT

A railcar system that includes a railcar having a first longitudinal gate and a second longitudinal gate. The system further includes a first beam and a second beam configured to move longitudinally with respect to the railcar. The system further includes a driving system configured to transition the first beam from a first position to a second position. The first longitudinal gate and the second longitudinal gate are both closed when the first beam is in the first position. The first longitudinal gate is at least partially open and the second longitudinal gate are closed when the first beam is in the second position. The driving system is also configured to transition the first beam from the second position to a third. The first longitudinal gate and the second longitudinal gate are both at least partially open when the first beam is in the third position.

20 Claims, 7 Drawing Sheets

RAILCAR WITH PROGRESSIVE OPENING LONGITUDINAL GATES

TECHNICAL FIELD

This disclosure relates generally to railcars and more particularly to railcars which discharge cargo or lading, such as coal, ore, ballast, grain, and any other lading suitable for transport in railcars.

BACKGROUND

Railway hopper cars with one or more hoppers are used for transporting commodities such as dry bulk. For example, hopper cars are frequently used to transport coal, sand, metal ores, ballast, aggregates, grain, and any other type of lading material. Commodities are discharged from openings typically located at or near the bottom of a hopper. A door or gate assembly is used to open and close discharge openings of a hopper. A hopper car may use multiple gate assemblies to discharge commodities at various locations along the length of the hopper car.

Existing hopper cars are configured such that all of the gate assemblies open simultaneously when a hopper car has multiple gate assemblies. Opening all of the gate assemblies at once may increase the amount of force used to open the gates. The system receiving the unloaded commodity may also be overwhelmed by too much product being discharged at once. Other existing systems require a hopper car to have separate opening mechanisms for each gate assembly. In these systems, each of the opening mechanisms is controlled independently. Having to separately open gate assemblies increases the time, labor, and complexity associated with operating the gate assemblies. Thus, it is desirable to provide more flexibility and options when discharging commodities.

SUMMARY

In one embodiment, the disclosure includes a railcar system that includes a railcar having a first longitudinal gate and a second longitudinal gate. The system further includes a first beam operably coupled to a second beam. The first beam and the second beam are configured to move longitudinally with respect to the railcar. The system further includes a first strut with a first end and a second end. The first end of the first strut connected to the first longitudinal gate and the second end of the first strut connected to the first beam. The system further includes a second strut with a first end and a second end. The first end of the second strut connected to the second longitudinal gate and the second end of the second strut connected to the second beam. The system further includes a driving system operably coupled to the first beam and configured to move the first beam longitudinally with respect to the railcar.

The driving system is configured to transition the first beam from a first position to a second position such that the first longitudinal gate and the second longitudinal gate are both closed when the first beam is in the first position. The first longitudinal gate is at least partially open and the second longitudinal gate are closed when the first beam is in the second position. The driving system is also configured to transition the first beam from the second position to a third position such that the first beam applies a force moving the second beam longitudinally with respect to the railcar while transitioning from the second position to the third position.

The first longitudinal gate and the second longitudinal gate are both at least partially open when the first beam is in the third position.

In another embodiment, the disclosure includes a railcar system that includes a railcar having a first longitudinal gate and a second longitudinal gate. The system further includes a first beam and a second beam configured to move longitudinally with respect to the railcar. The system further includes a first strut with a first end of the first strut connected to the first longitudinal gate and a second end of the first strut connected to the first beam. The system further includes a second strut with a first end of the second strut connected to the second longitudinal gate and a second end of the second strut connected to the second beam. The system further includes a first pneumatic cylinder operably coupled to the first beam and configured to move the first beam longitudinally with respect to the railcar. The system further includes a second pneumatic cylinder operably coupled to the second beam and configured to move the second beam longitudinally with respect to the railcar. The system further includes a conduit configured to provide a flow path from an outlet port of the first pneumatic cylinder to an inlet port of the second pneumatic cylinder.

The first pneumatic cylinder is configured to transition the first beam from a first position to a second position in response to receiving a first air pressure level at an inlet port of the first pneumatic cylinder. The first longitudinal gate and the second longitudinal gate are both closed when the first beam is in the first position. The first longitudinal gate is at least partially open and the second longitudinal gate are closed when the first beam is in the second position. The first pneumatic cylinder is further configured to apply a force to a piston of the second pneumatic cylinder in response to receiving a second air pressure level greater than the first air pressure level at the inlet port of the first pneumatic cylinder. Applying the force to the piston of the second pneumatic cylinder transitions the second beam from a first position to a second position. The first longitudinal gate and the second longitudinal gate are both at least partially open when the second beam is in the second position.

Various embodiments present several technical advantages, such as providing a progressive opening longitudinal gate assembly that allows a railcar (e.g. a hopper car) to progressively open longitudinal gates. The progressive opening longitudinal gate assembly provides the ability for a rail car to sequentially open longitudinal gates when a railcar has multiple longitudinal gates. The progressive opening longitudinal gate assembly allows a rail car to partially unload the railcar by only opening some of the longitudinal gates. This provides more flexibility than existing system that require railcars to open all of their longitudinal gates at the same time and cannot be configured to only open some of the longitudinal gates. The progressive opening longitudinal gate assembly also provides variable discharge rates by allowing each subsequent set of longitudinal doors be opened after different predetermined time intervals. By progressively opening longitudinal gates, peak mechanism forces are reduced and unloading can be controlled by sequentially opening longitudinal gates.

Certain embodiments of the present disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Disclosed herein are various embodiments of progressive opening longitudinal gate assembly that allows a railcar (e.g. a hopper car) to progressively open longitudinal gates, for example, to discharge dry bulk. The progressive opening longitudinal gate assembly provides the ability for a rail car to sequentially open longitudinal gates when a railcar has multiple longitudinal gates. The progressive opening longitudinal gate assembly allows a rail car to partially unload the railcar by only opening some of the longitudinal gates. This provides more flexibility than existing system that require railcars to open all of their longitudinal gates at the same time and cannot be configured to only open some of the longitudinal gates. By progressively opening longitudinal gates, peak mechanism forces are reduced and unloading can be controlled by sequentially opening longitudinal gates.

Figure 1:
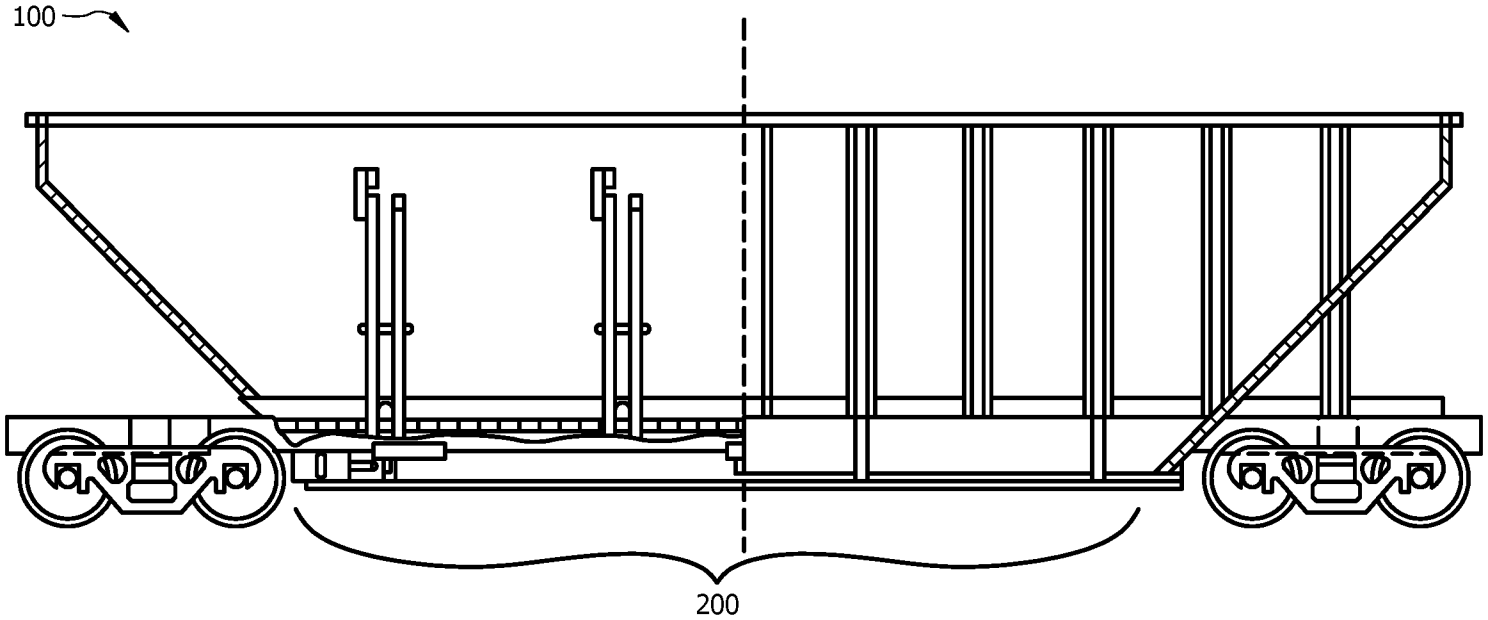
FIG. 1 is a partial cutaway side view of an embodiment of railcar with a progressive opening longitudinal gate assembly.

FIG. 1 is a partial cutaway side view of an embodiment of railcar 100 with a progressive opening longitudinal gate assembly 200. In FIG. 1, the railcar 100 is a hopper car. A hopper car is configured to carry and transport bulk materials such as coal, lading material, sand, grain, metal ores, aggregate, ballast, and/or any other suitable type of material. In one embodiment, the railcar 100 is configured with an open top and bottom discharge openings or outlets. The railcar 100 comprises one or more longitudinal gates (not shown) configured to open and close to control the discharge of materials from the discharge openings of the railcar 100. In other embodiments, the railcar 100 may be a gondola car, a closed hopper car, or another suitable type of railcar.

In one embodiment, the progressive opening longitudinal gate assembly 200 is disposed at or near a bottom portion of the railcar 100. The progressive opening longitudinal gate assembly 200 is configured to allow commodities to be discharged from the railcar 100 via the one or more longitudinal gates of the railcar 100. For example, the progressive opening longitudinal gate assembly 200 is configured to sequentially open longitudinal gates to allow commodities to discharge from the railcar 100 progressively. Each subsequent longitudinal gate is opened after some predetermined amount of delay. The delay may be in terms of seconds, minutes, hours, or any other suitable amount of time. Additional information about the progressive opening longitudinal gates assembly 200 is described in FIGS. 2, 3, 4A-4C, 5A-5C, and 6A-6C.

Figure 2:
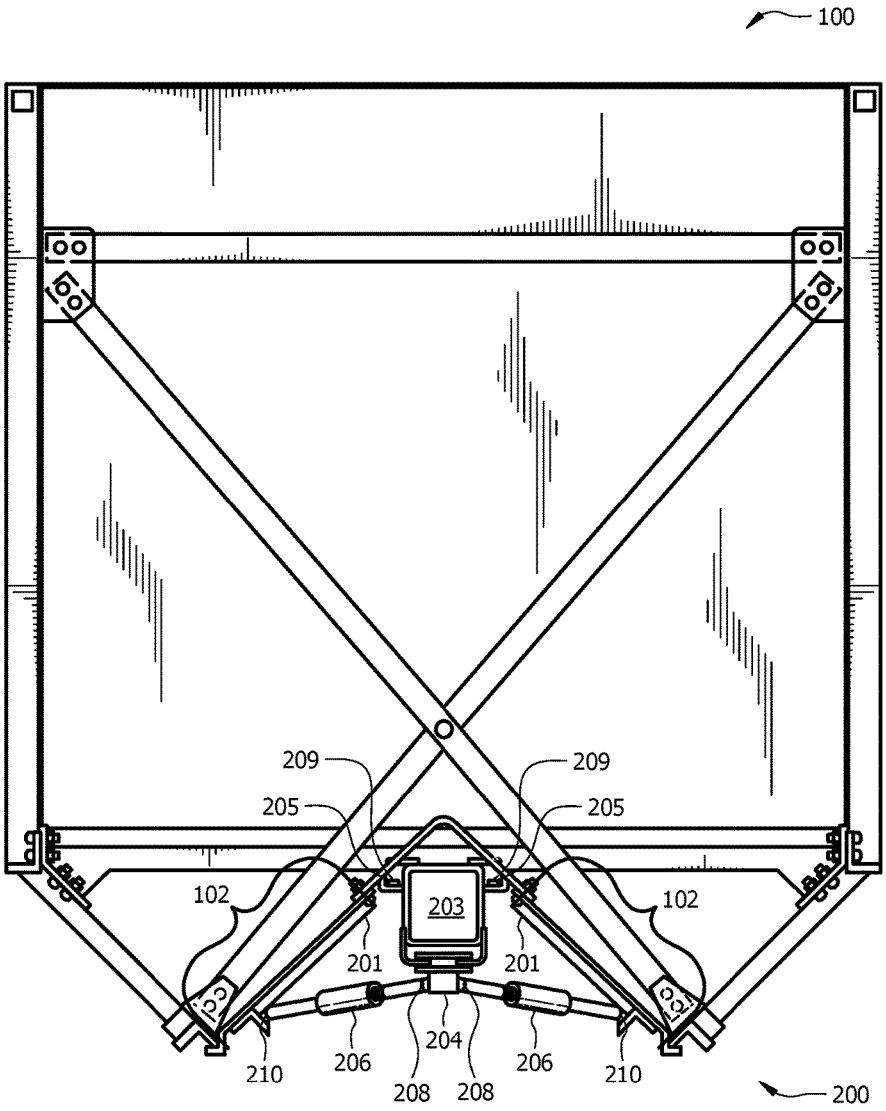
FIG. 2 is an end view of an embodiment of a railcar with longitudinal gates in a closed position.
Figure 3:
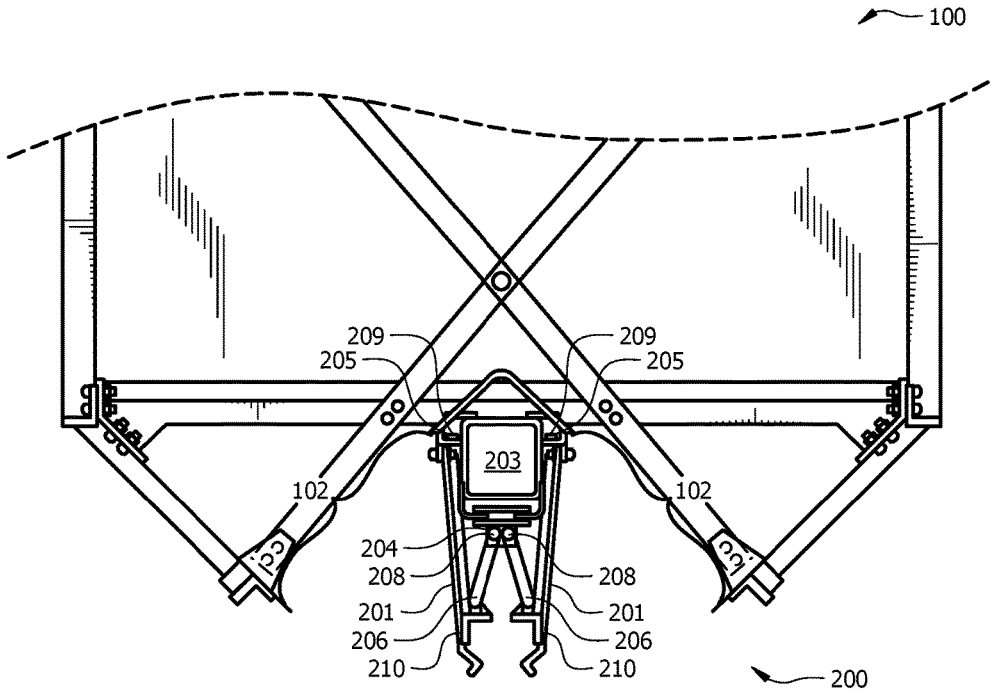
FIG. 3 is an end view of an embodiment of a railcar with longitudinal gates in an open position.

Longitudinal gates are configurable between a closed position (shown in FIG. 2) and an open position (shown in FIG. 3). FIG. 2 is an end view of an embodiment of the railcar 100 with longitudinal gates 201 in a closed position. Longitudinal gates 201 are formed with dimensions suitable for covering discharge openings 102 of a railcar 100. Longitudinal doors 201 may be formed of metals, composites, plastics, or any other suitable material as would be appreciated by one of ordinary skill in the art. When the longitudinal gates 201 are in the closed position, the longitudinal gates 201 substantially prevent material from being discharged from the railcar 100. For example, the longitudinal gates 201 are positioned to cover discharge openings 102 on the bottom of the railcar 100 when the longitudinal gates 201 are in the closed position.

The longitudinal gates 201 are coupled to a center sill 203 at a first end 209 of the longitudinal gate 201 using a hinge assembly 205 and to a strut 206 at a second end 210 of the longitudinal gate 201. The center sill 203 may form a portion of the frame or underframe of the railcar 100. The center sill 203 is oriented longitudinally with respect to the railcar 100. In FIG. 2, the center sill 203 is shown having a generally rectangular cross-section. In other examples, the center sill 203 may have any other shape cross-section. The hinge assembly 205 is configured to pivotally attach the longitudinal gate 201 to the center sill 203. The hinge assembly 205 comprises a mechanical hinge that allows the longitudinal gates 201 to transition between the closed position and the open position. Examples of hinges include, but are not limited to, piano type hinges, spring hinges, continuous hinges, butt hinges, slip apart hinges, and weld-on hinges.

In one embodiment, the struts 206 may have an adjustable length. For example, the struts 206 may comprise a turnbuckle forming part of the strut 206. The turnbuckle is configured such that rotating the turnbuckle extends or contracts the length of a strut 206. The struts 206 further comprise ball joints or links configured to engaged with and connect the strut 206 to other components (e.g. the longitudinal gate 201). In one embodiment, the strut 206 is configured to apply a compressive force to maintain the longitudinal gate 201 in the closed position.

The strut 206 is configured to couple the longitudinal gates 201 with a beam 204. The beam 204 is slidably coupled to the center sill 203 and is configured to move (e.g. slide) longitudinally with respect to the railcar 100 along the center sill 203. The longitudinal gates 201 are configured to transition between the closed position and the open position based on the position of the beam 204. Examples of repositioning the beam 204 to transition the longitudinal gates 201 between the closed position and the open position are shown in FIGS. 4A-4C, 5A-5C, and 6A-6C.

FIG. 3 is an end view of an embodiment of the railcar 100 with longitudinal gates 201 in an open position. When the longitudinal gates 201 are in the open position, the longitudinal gates 201 allows material to be discharged from the railcar 100. For example, the longitudinal gates 201 are positioned to at least partially uncover the discharge openings 102 which allows material to exit the railcar 100 via the discharge openings 102 on the bottom of the railcar 100.

Figure 4A:
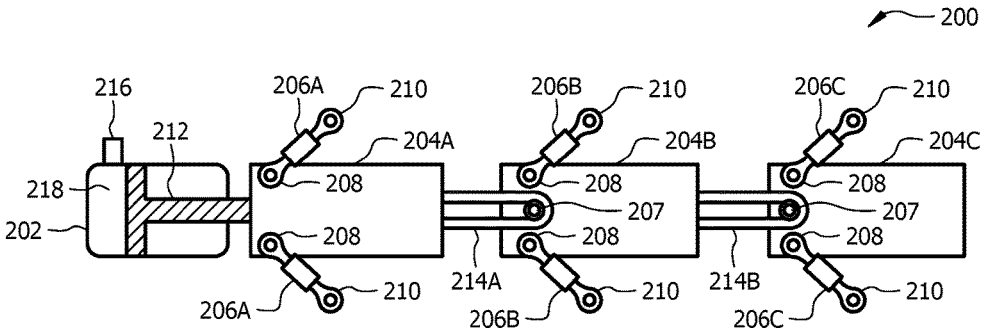
FIGS. 4A-4C are top views of an embodiment of a progressive opening longitudinal gate assembly in various stages of operation.
Figure 4B:
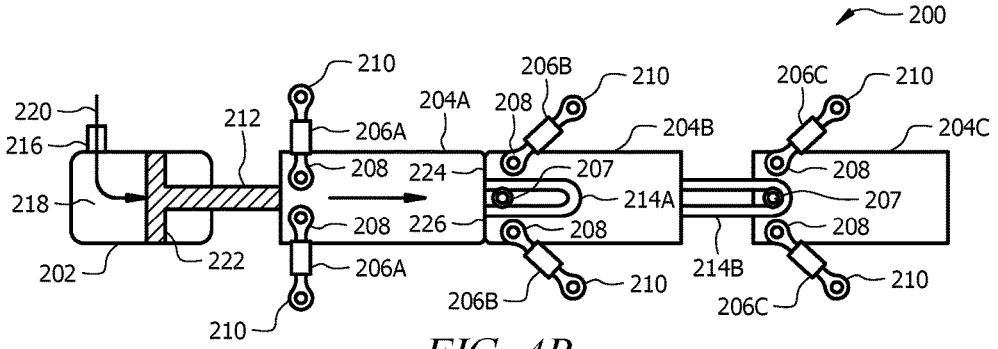
Figure 4C:
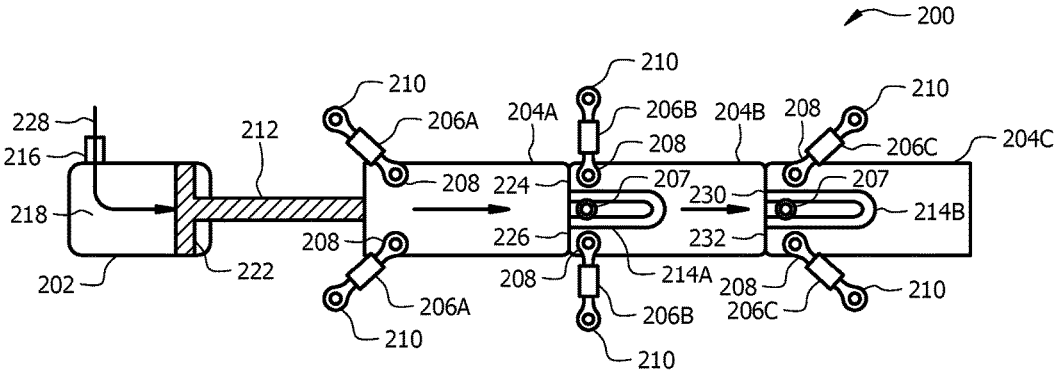

FIGS. 4A-4C are top views of an embodiment of a progressive opening longitudinal gate assembly 200 in various stages of operation. FIGS. 4A-4C illustrate an embodiment of a sequence of actions that occur as the progressive opening longitudinal gate assembly 200 sequentially opens sets of longitudinal gates 201 of a railcar 100.

FIG. 4A shows the progressive opening longitudinal gate assembly 200 configured with beams 204 positioned to maintain all of the longitudinal gates 201 in a closed position. The progressive opening longitudinal gate assembly 200 comprises a driving system 202 and a plurality of beams 204. In this example, the progressive opening longitudinal gate assembly 200 comprises a driving system 202, a first beam 204A, a second beam 204B, and a third beam 204C. In other examples, the progressive opening longitudinal gate assembly 200 comprises any other suitable number of beams 204.

The driving system 202 is operably coupled to the first beam 204A and is configured to move the first beam 204A longitudinally with respect to the railcar 100. For example, the driving system 202 is configured to slide the beam 204A along the center sill 203. In one embodiment, the driving system 202 is a pneumatic cylinder. In this example, the driving system 202 comprises an inlet port 216 and a piston 212. The inlet port 216 is configured to allow an air pressure to be applied to an interior chamber 218 of the driving system 202. For example, an air pressure may be applied to the interior chamber 218 to move the piston 212 within the driving system 202.

The piston 212 is configured with a head portion 222 of the piston 212 disposed within the driving system 202 and a portion of the piston 212 protruding out of the driving system 202. The piston 202 is configured to move (e.g. slide) in response to an air pressure being applied to the interior chamber 218 of the driving system. Examples of the piston 212 moving in response to an application of air pressure are described in FIGS. 4B and 4C. The piston 212 is configured to protrude further out of the driving system 202 as the level of air pressure being applied to the interior chamber 218 increases. The piston 212 is coupled to the first beam 204A and is configured to move the first beam 204A as the piston 212 moves.

In other embodiments, the driving system 202 comprises a hydraulic cylinder, a motor, levers, gears, capstans, cables, ropes, or any other suitable devices configured to move the first beam 204A longitudinally with respect to the railcar 100. For example, the driving system 202 may be a hydraulic cylinder configured to operate similar to the previously described pneumatic cylinder. The driving system 202 is configured to move the first beam 204 in response to an application of hydraulic fluid pressure being applied to the interior chamber 218 of the hydraulic cylinder. As another example, the driving system 202 may be a motor comprising a rotating shaft and is configured to move the first beam 204A by rotating the shaft. For instance, the rotating shaft may be coupled to a gear assembly used to move the first beam 204A.

The first beam 204A comprises struts 206A and an elongated link 214A. The struts 206A are coupled to the first beam 204A at a first end 208 of the struts 206A and coupled to longitudinal gates 201 (not shown) at a second end 210 of the struts 206A. The struts 206A are configured to pivot about the first end 208 of the strut 206A to transition the longitudinal gates 201 between the closed position and the open position. In FIG. 4A, the struts 206A are shown in an orientation that corresponds with the longitudinal gates 201 coupled to the struts 206A being in the closed position. The elongated link 214A couples the first beam 204A to the second beam 204B. For example, the elongated link 214A is configured to engage with a beam pin 207 on the second beam 204B. The elongated link 214A comprises a slot sized to allow the beam pin 207 on the second beam 204B to move within the slot of the elongated link 214A as the first beam 204A moves.

The second beam 204B comprises struts 206B and an elongated link 214B configured similarly as struts 206A and elongated link 214A. The struts 206B are coupled to the second beam 204B at a first end 208 of the struts 206B and coupled to longitudinal gates 201 (not shown) at a second end 210 of the struts 206B. In FIG. 4A, struts 206B are shown in an orientation that corresponds with the longitudinal gates 201 coupled to the struts 206B being in the closed position. The elongated link 214B couples the second beam 204B to the third beam 204C. The elongated link 214B comprises a slot sized to allow a beam pin 207 on the third beam 204C to move within the slot of the elongated link 214B as the second beam 204B moves.

The third beam 204C comprises struts 206C configured similarly as struts 206A and 206B. The struts 206C are coupled to the third beam 204C at a first end 208 of the struts 206C and coupled to longitudinal gates 201 (not shown) at a second end 210 of the struts 206C. In FIG. 4A, struts 206C are shown in an orientation that corresponds with the longitudinal gates 201 coupled to the struts 206C being in the closed position.

FIG. 4B shows the progressive opening longitudinal gate assembly 200 configured with the first beam 204A positioned such that a first set of longitudinal gates 201 are ready to open while the second beam 204B and the third beam 204C maintain their longitudinal gates 201 in the closed position.

In FIG. 4B, a first air pressure level 220 is applied to the inlet port 216 and the interior chamber 218 of the driving system 202. The first air pressure level 220 generates a force that is applied to the head 222 of the piston 212 and is sufficient to move the piston 212 in a direction toward the first beam 204A. As the piston 212 moves, the first beam 204A moves in a direction toward the second beam 204B which transitions the first beam 204A from its original position (i.e. a first position) to a new position (i.e. a second position). In the second position, the struts 206A of the first beam 204A are in an orientation that corresponds with the longitudinal gates 201 coupled to the struts 206A being in a position that is ready to transition from the closed position to the open position or an at least partially open position. In other words, the longitudinal gates 201 are in the closed position but may transition to the open position if the first beam 204A continues to move towards the second beam 204B. In some embodiments, this strut orientation may be referred to as an over-center position. In one embodiment, a surface 224 of the first beam 204A may be in contact with a surface 226 of the second beam 204B when the first beam 204A is in the second position.

As first beam 204A moves towards the second beam 204B, the second beam 204B and the third beam 204C are configured to remain in about their original position with respect to the railcar 100. The elongated link 214A of the first beam 204A and beam pin 207 of the second beam 204B allow the first beam 204A to remain coupled to the second beam 204B while allowing the first beam 204A to move toward the second beam 204B without causing the second beam 204B to move with the first beam 204A.

FIG. 4C shows the progressive opening longitudinal gate assembly 200 configured with the first beam 204A such that the first set of longitudinal gates 201 are in the open position, the second beam 204B is positioned such that a second set of longitudinal gates 201 are ready to open, and the third beam 204C is positioned such that a third set of longitudinal gates 201 remain in the closed position.

In FIG. 4C, a second air pressure level 228 is applied to the inlet port 216 and the interior chamber 218 of the driving system 202. The second air pressure level 228 is greater than the first air pressure level 220 used in FIG. 4B. The second air pressure level 228 generates a force that is applied to the head 222 of the piston 212 and moves the piston 212 further in the direction towards the first beam 204A. As the piston 212 moves, the first beam 204A moves in a direction towards the second beam 204B which transitions the first beam 204A from the second position to a third position. In the third position, the struts 206A of the first beam 204A are in an orientation that corresponds with the longitudinal gates 201 coupled to the struts 206A being the open position.

As the first beam 204A moves, the first beam 204A applies a force to the second beam 204B which causes the second beam 204B to move from its original position (i.e. a first position) to a new position (i.e. a second position). For example, the surface 224 of the first beam 204A may apply a force to the surface 226 of the second beam 206B to move the second beam 204B. In the second position, the struts 206B of the second beam 204B are in an orientation that corresponds with the longitudinal gates 201 coupled to the struts 206B being in a position that is ready to transition from the closed position to the open position or an at least partially open position. In one embodiment, a surface 230 of the second beam 204B may be in contact with a surface 232 of the third beam 204C when the second beam 204B is in the second position.

In FIG. 4C, the second beam 204B moves with the first beam 204A as the first beam 204A moves towards the second beam 204B. In other words, both the first beam 204A and the second beam 204B move together. As the first beam 204A and the second beam 204B move, the third beam 204C is configured to remain in about its original position with respect to the railcar 100. The elongated link 214B of the second beam 204B and the beam pin 207 of the third beam 204C allow the second beam 204B to remain coupled to the third beam 204C while allowing the second beam 204B to move toward the third beam 204C without causing the third beam 204C to move with the second beam 204B.

In one embodiment, the driving system 202 is configured to close the longitudinal gates 201 by performing the previously described actions in the reverse order. For example, the driving system 202 may move the first beam 204A in a direction towards the driving system 202 to close the longitudinal gates 201. In one embodiment, a negative are pressure (e.g. a vacuum) may be applied to the inlet port 216 of the driving system 202 to operate the piston 212 to move the first beam 204A in the direction towards the driving system 202.

Figure 5A:
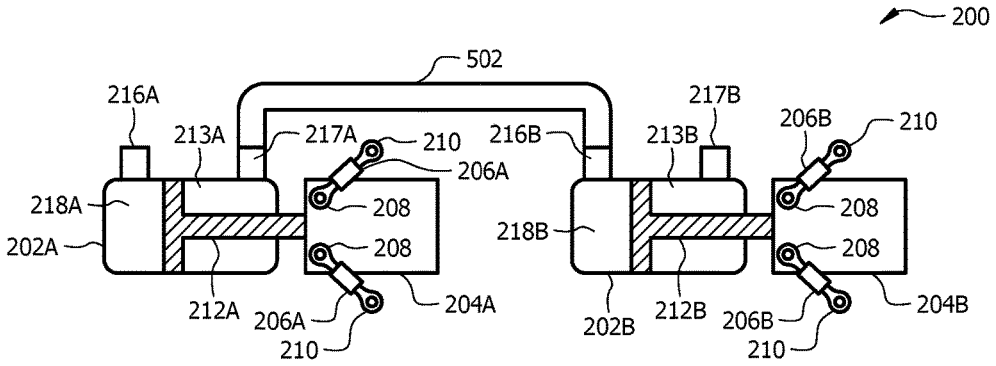
FIGS. 5A-5C are side views of another embodiment of a progressive opening longitudinal gate assembly in various stages of operation.
Figure 5B:
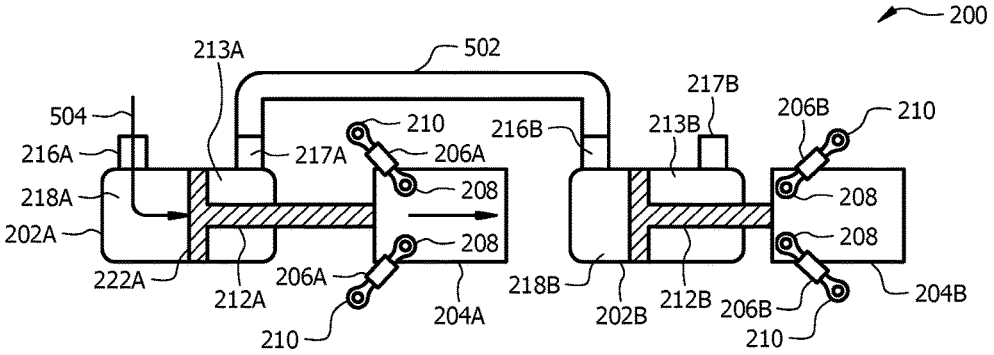
Figure 5C:
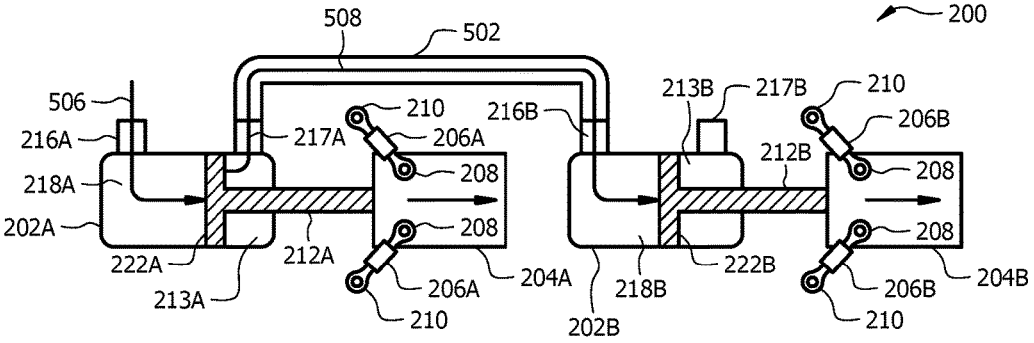

FIGS. 5A-5C are side views of another embodiment of a progressive opening longitudinal gate assembly 200 in various stages of operation. FIGS. 5A-5C illustrate an embodiment of a sequence of actions that occur as the progressive opening longitudinal gate assembly 200 sequentially opens longitudinal gates 201 of a railcar 100.

FIG. 5A shows the progressive opening longitudinal gate assembly 200 configured with beams 204 positioned to maintain all of the longitudinal gates 201 in the closed position. The progressive opening longitudinal gate assembly 200 comprises a first driving system 202A operably coupled to a first beam 204A and a second driving system 204B operably coupled to a second beam 204B. In other examples, the progressive opening longitudinal gate assembly 200 comprises any other suitable number of driving systems 202 and/or beams 204.

In one embodiment, the first driving system 202A and the second driving system 202B are pneumatic cylinders. In this example, the first driving system 202A comprises an inlet port 216A, a piston 212A, and an outlet port 217A. The inlet port 216A is configured to allow an air pressure to be applied to a first interior chamber 218A of the first driving system 202A. The air pressure may be applied to the first interior chamber 218A of the first driving system 202A to move the piston 212A similar to as described to movepiston 212 in FIGS. 4A-4C.

The piston 212A is configured to similar to the piston 212 described in FIGS. 4A-4C. The piston 212A is configured with a head portion 222A of the piston 212A disposed within the first driving system 202A and a portion of the piston 212A protruding out of the first driving system 202A. The piston 212A is coupled to the first beam 204A and is configured to move the first beam 204A as the piston 212A moves. The first beam 204A comprises struts 206A. The struts 206A are coupled to the first beam 204A at a first end 208 of the struts 206A and coupled to longitudinal gates 201 (not shown) at a second end 210 of the struts 206A. In FIG. 5A, the struts 206A are shown in an orientation that corresponds with the longitudinal gates 201 coupled to the struts 206A being in the closed position.

The outlet port 217A is configured to allow air or fluid to exit a second interior chamber 213A of the first driving system 202A. For example, air may be forced out of the second interior chamber 213A in response to the piston 212A applying a compressive force to the second interior chamber 213A as the piston 212A moves in a direction toward the first beam 204A.

Similarly, the second driving system 202B comprises an inlet port 216B, a piston 212B, and an outlet port 217B. The inlet port 216B is configured to allow an air pressure to be applied to a first interior chamber 218B of the second driving system 202B. The air pressure may be applied to the first interior chamber 218B of the second driving system 202B to move the piston 212B similar to as previously described. The piston 212B is configured with a head 222B portion of the piston 212B disposed within the second driving system 202B and a portion of the piston 212B protruding out of the second driving system 202B. The piston 212B is coupled to the second beam 204B and is configured to move the second beam 204B as the piston 212B moves. The second beam 204B comprises struts 206B. The struts 206B are coupled to the second beam 204B at a first end 208 of the struts 206B and coupled to longitudinal gates 201 (not shown) at a second end of the struts 206B. In FIG. 5A, the struts 206B are shown in an orientation that corresponds with the longitudinal gates 201 coupled to struts 206B being in the closed position.

The outlet port 217B is configured to allow air or fluid to exit a second interior chamber 213B of the second driving system 202B. For example, air may be forced out of the second interior chamber 213B in response to the piston 212B applying a compressive force to the second interior chamber 213B as the piston 212B moves in a direction toward the second beam 204B.

The outlet port 217A of the first driving system 202A is coupled to the inlet port 216B of the second driving system 202B using a conduit 502. The conduit 502 is configured to provide a flow path between the outlet port 217A of the first driving system 202A and the inlet port 216B of the second driving system 202B. For example, the conduit 502 is configured to allow air or a fluid to be communicated from the first driving system 202A (e.g. the second interior chamber 213A) to the second driving system 202B (e.g. the first interior chamber 218B) via the conduit 502. Examples of conduit 502 include, but are not limited to, tubing, hosing, piping, and any other suitable structure for communicating air or fluid between the first driving system 202A and the second driving system 202B. In other embodiments, the progressive opening longitudinal gate assembly 200 comprises any other suitable number of driving systems 202 connected in series using conduits 502.

FIG. 5B shows the progressive opening longitudinal gate assembly 200 configured with the first beam 204A positioned such that the first set of longitudinal gates 201 are in the open position and the second beam 204B is positioned such that the second set of longitudinal gates 201 are in the closed position. In FIG. 5B, a first air pressure level 504 is applied to the inlet port 216A and the first interior chamber 218A of the first driving system 202A. The first air pressure level 504 generates a force that is applied to the head 222A of the piston 212A and is sufficient to move the piston 212A in a direction towards the first beam 204A. As the piston 212A moves, the first beam 204A moves with the first beam 204A which transitions the first beam 204A from its original position (i.e. a first position) to a new position (i.e. a second position). In the second position, the struts 206A of the first beam 204A are in an orientation that corresponds with the longitudinal gates 201 coupled to the struts 206A being in the open position or an at least partially open position.

In this example, as the first beam 204A transitions from the first position to the second position, the second beam 204B is configured to remain in about its original position with respect to the railcar 100.

FIG. 5C shows the progressive opening longitudinal gate assembly 200 configured with the first beam 204A positioned such that the first set of longitudinal gates 201 are in the open position and the second beam 204B is positioned such that the second set of longitudinal gates 201 are in the open position. In FIG. 5C, a second air pressure level 506 is applied to the inlet port 216A and the first interior chamber 218A of the first driving system 202A. The second air pressure level 506 is greater than the first air pressure level 504 used in FIG. 5B. The second air pressure level 506 generates a force that is applied to the head 222A of piston 212A. In one embodiment, the piston 212A moves further in the direction of the first beam 204A in response to the force generated by the second air pressure level 506. For example, the piston 212A may transition longitudinal gates 201 coupled to the first beam 204A from a partially open position to a fully open position in response to the application of the second air pressure level 506 to the first driving system 202A. In other examples, the first beam 204A does not move and remain in their current position. For example, the first beam 204A may not move when longitudinal gates 201 coupled to the first beam 204A are already in a fully open position.

As the piston 212A moves, a volume of air or fluid in a second interior chamber 213A of the first driving system 202A is pushed out of the first driving system 202A via the outlet port 217A. For example, as the piston 212A moves in a direction toward the first beam 204A, air is communicated from the second interior chamber 213A of the first driving system 202A to the interior chamber 218B of the second driving system 202B via the conduit 502. The air volume communicated from the second interior chamber 213A generates a force 508 that is applied to the head 222B of the piston 212B and moves the piston 212B in a direction towards the second beam 204B. As the piston 212B moves, the second beam 204B moves with the piston 212B which transitions the second beam from its original position (i.e. a first position) to a new position (i.e. a second position). In the second position, the struts 206B of the second beam 204B are in an orientation that corresponds with the longitudinal gates 201 coupled to the struts 206B being in the open position or an at least partially open position.

In one embodiment, the amount of air or fluid and/or type (e.g. compressible or incompressible) contained within the second interior chamber 213A of the first driving system 202A, the conduit 502, and the first interior chamber 218B of the second driving system 202B may be used to control relationship between when the first beam 204A and the second beam 204B transitions from the first position to the second position, respectively. For example, the progressive opening longitudinal gate assembly 200 may be configured to transition the first beam 204A and the second beam 204B about simultaneously. In this example, the volume contained within the second interior chamber 213A of the first driving system 202A, the conduit 502, and the first interior chamber 218B of the second driving system 202B may be dense and/or substantially incompressible causing the piston 212A and the piston 212B to move at the same time.

In another example, the progressive opening longitudinal gate assembly 200 may be configured to introduce a delay between transitioning the first beam 204 and the second beam 204B. In this example, the volume contained within the second interior chamber 213A of the first driving system 202A, the conduit 502, and the first interior chamber 218B of the second driving system 202B may be less dense and/or compressible causing delay from the time the piston 212A moves and the piston 212B moves. The amount of delay may be controlled based on the amount of time used to generate enough force on the head 222B to move the piston 212B.

In another embodiment, the conduit diameter, conduit length, valves, or any other components may be used to introduce a delay between transitioning the first beam 204 and the second beam 204B. For example, increasing the diameter and/or length of the conduit 502 may introduce more delay.

In FIGS. 5A-5C, piston 212A and 212B are shown having the same length and structure. In other embodiments, piston 212A and 212B may have different lengths and/or structures which may be used to cause a delay between transitioning the first beam 204A and the second beam 204B. For example, pistons 212A and 212B may have different head thicknesses and/or stroke lengths.

Figure 6A:
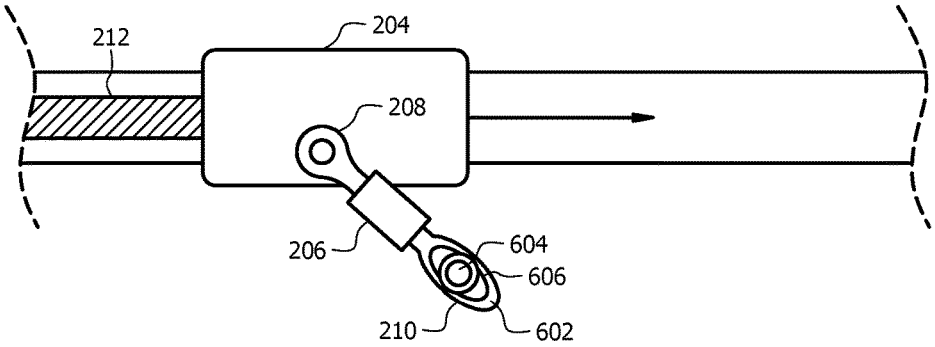
FIGS. 6A-6C are side views of an embodiment of a strut with an elongated link.
Figure 6B:
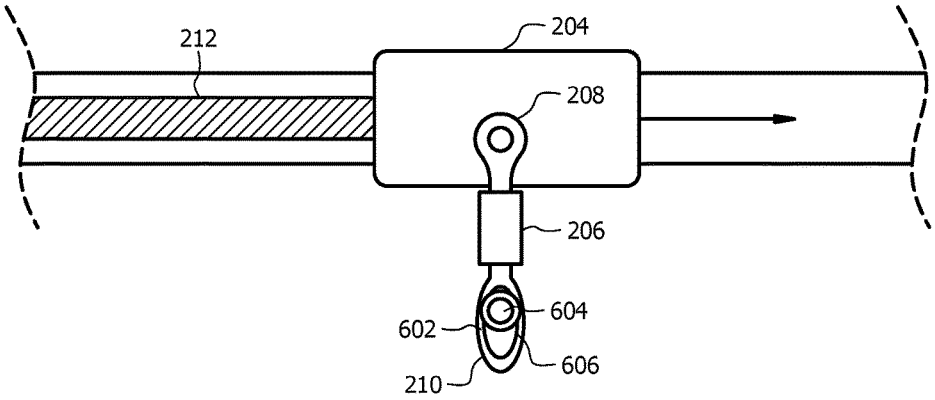
Figure 6C:
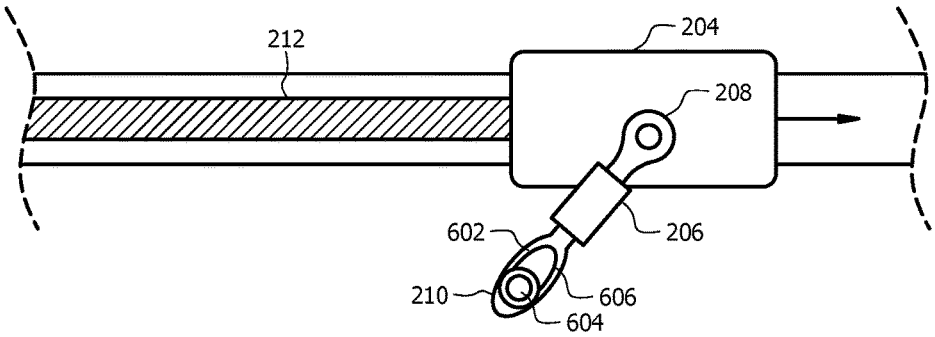

FIGS. 6A-6C are side views of an embodiment of a strut 206 with an elongated link 602. In one embodiment, a strut 206 may be configured with an elongated link 602 that allows a beam 204 to travel some distance before moving a longitudinal door 201. In other words, a strut 206 with an elongated link 602 allows a beam 204 to move without moving the longitudinal door 201 coupled to the beam 204.

FIG. 6A shows a beam 204 in a first position where the beam 204 is positioned in front of a gate pin 604 of a longitudinal door 201 (not shown). The beam 204 is coupled to the longitudinal door 201 using the elongated link 602 and the gate pin 604. The elongated link 602 comprises a slot 606 configured to allow the gate pin 604 to move within the slot 606 while the beam 204 moves longitudinally with respect to a railcar 100.

FIG. 6B shows a beam 204 in a second position where the beam 204 is positioned about over center of the gate pin 604 of the longitudinal door 201 (not shown). As the beam 204 moves from the first position to the second position, the gate pin 604 moves within the slot 606 of the elongated link 602 and the longitudinal gate 201 remains in the closed position.

FIG. 6C shows a beam 204 in a third position where the beam 204 is positioned beyond the over center position of the gate pin 604 of the longitudinal door 201 (not shown). In the third position, the beam 204 is engaged with the longitudinal gate 201 and is able to move or transition the longitudinal gate 201. When the beam 204 is in the third position, the gate pin 604 engages the end of the slot 606 of the elongated link 602 and any further movement of the beam 204 past the gate pin 604 causes the longitudinal gate 201 to move with the beam 204, for example, to transition the longitudinal gate 210 from the closed position to the open position. The length of the slot 606 may be varied to control how far the beam 204 can travel past the gate pin 604 before the beam 204 engages and/or move the longitudinal gate 201.

Figure 7:
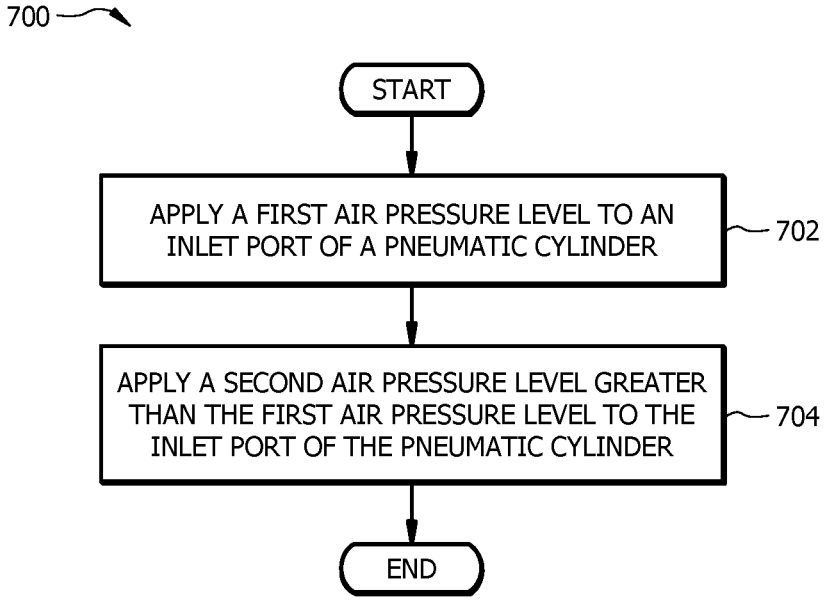
FIG. 7 is a flowchart of an embodiment of a longitudinal gate opening method.

FIG. 7 is a flowchart of an embodiment of a longitudinal gate opening method 700. In an embodiment, an operator or controller (e.g. a microcontroller or control system) may employ method 700 to sequentially open pairs of longitudinal gates 201. For example, the controller may open a first set of longitudinal gates 201 to partially discharge a material from a railcar 100. After some period of time, the controller opens a second set of longitudinal gates 201 to further discharge the material from the railcar 100. In this example, the driving system 202 is a pneumatic cylinder. In one embodiment, the progressive opening longitudinal gate assembly 200 may be configured similar to as described in FIGS. 4A-4C or 5A-5C.

At step 702, the controller applies a first air pressure level to an inlet port of pneumatic cylinder. The first air pressure level generates a force that moves a piston 212 of the pneumatic cylinder and a first beam 204 coupled to the piston 212. As the piston 212 moves, the first beam 204 transitions a first set of longitudinal gates 201 from the closed position to an at least partially open position. A second set of longitudinal gates 201 coupled to a second beam 204 of the progressive opening longitudinal gate assembly 200 remains in the closed position both when the first set of longitudinal gates 201 is in the closed position and when the first set of longitudinal gates 201 is in the at least partially open position. For example, the first beam 204 and the second beam 204 may be configured similar to first beam 204A and the second beam 204B in FIG. 4B or FIG. 5B, respectively.

At step 704, the controller applies a second air pressure level to the inlet port of the pneumatic cylinder. In this example, the second air pressure level is greater than the first air pressure level. In one embodiment, the second air pressure level causes the piston 212 to move further in the direction of the first beam 204. The movement of the piston 212 causes the first beam 204 to engage with the second beam 204 and to apply a force to the second beam 204 causing the second beam 204 to move. As the second beam 204 moves, the second set of longitudinal gates 201 transitions from the closed position to an at least partially open position. For example, the first beam 204 and the second beam 204 may be configured similar to first beam 204A and the second beam 204B in FIG. 4C, respectively.

In another embodiment, the second air pressure level causes the piston 212 to move further in the direction of the first beam 204. The movement of the piston 212 causes a volume of air to transfer from pneumatic cylinder to a second pneumatic cylinder via a conduit 502. The volume of air that is transferred generates a force that is applied to the head 222 of the piston 212 of the second pneumatic cylinder and causes the piston 212 of the second pneumatic cylinder to move in the direction of the second beam 204. As the piston 212 of the second pneumatic cylinder moves, the second beam 204 moves with the piston 212 which causes the second set of longitudinal gates 201 to transition from the closed position to an at least partially open position. For example, the first beam 204 and the second beam 204 may be configured similar to first beam 204A and the second beam 204B in FIG. 5C, respectively.

In one embodiment, steps 702 and 704 may be repeated one or more time to transition other longitudinal gates 201 from the closed position to the open position. In some embodiments, steps 702 and 704 may be performed in the reverse order to close one of more sets of longitudinal gates 201.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A railcar system comprising:

a railcar comprising a first longitudinal gate and a second longitudinal gate;

a first beam operably coupled to a second beam, wherein the first beam and the second beam are configured to move longitudinally with respect to the railcar;

a first strut comprising a first end and a second end, wherein:

the first end of the first strut is connected to the first longitudinal gate, and the second end of the first strut is connected to the first beam;

a second strut comprising a first end and a second end, wherein:

the first end of the second strut is connected to the second longitudinal gate, and the second end of the second strut is connected to the second beam;

a driving system operably coupled to the first beam, wherein:

the driving system is configured to move the first beam longitudinally with respect to the railcar, the driving system is configured to transition the first beam from a first position to a second position, wherein:

the first longitudinal gate and the second longitudinal gate are both closed when the first beam is in the first position, and the first longitudinal gate is at least partially open and the second longitudinal gate are closed when the first beam is in the second position;

the driving system is configured to transition the first beam from the second position to a third position, wherein:

the first beam applies a force moving the second beam longitudinally with respect to the railcar while transitioning from the second position to the third position, and the first longitudinal gate and the second longitudinal gate are both at least partially open when the first beam is in the third position.

2. The system of claim 1, wherein:

the first beam comprises an elongated link;

the second beam comprises a beam pin, wherein the beam pin is configured to move within a slot of the elongated link when the first beam moves from the first position to the second position; and the first beam is operably coupled to the second beam using the elongated link and the beam pin.

3. The system of claim 1, wherein:

the first end of the first strut comprises an elongated link; and the first longitudinal gate comprises a gate pin, wherein the gate pin is configured to move within a slot of the elongated link when the first beam moves from the first position to the second position.

4. The system of claim 1, wherein:

the driving system is a pneumatic cylinder comprising a piston;

the driving system is configured to move the first beam from the first position to the second position using the piston in response to receiving air pressure at an inlet port of the pneumatic cylinder; and the driving system is configured to move the first beam from the second position to the third position in response to increasing the air pressure at the inlet port of the pneumatic cylinder.

5. The system of claim 1, wherein:

the driving system is a hydraulic cylinder comprising a piston;

the driving system is configured to move the first beam from the first position to the second position using the piston in response to receiving fluid pressure at an inlet port of the hydraulic cylinder; and the driving system is configured to move the first beam from the second position to the third position in response to increasing the fluid pressure at the inlet port of the hydraulic cylinder.

6. The system of claim 1, wherein:

the driving system is a motor comprising a rotating shaft; and the driving system is configured to rotate the shaft to move the first beam.

7. The system of claim 1, wherein:

the first strut is configured to apply a compressive force to the first longitudinal gate when the first longitudinal gate is closed; and the second strut is configured to apply a compressive force to the second longitudinal gate when the second longitudinal gate is closed.

8. The system of claim 1, wherein the driving system is configured to wait a predetermined amount of time between transitioning the first beam from the first position to the second position and transitioning the first beam from the second position to the third position.

9. The system of claim 1, wherein the first beam is in contact with the second beam when the first beam is in the first position.

10. The system of claim 1, wherein the first strut is beyond the over center position when the first beam is in the second position.

11. A longitudinal gate opening method:

applying a first air pressure level to an inlet port of a pneumatic cylinder disposed on a railcar, wherein:

applying the first air pressure level transitions a first beam from a first position to a second position, a first longitudinal gate of the railcar coupled to the first beam transitions from a closed configuration to an at least partially open configuration when the first beam transitions from the first position to the second position, the first beam is operably coupled to a second beam, a second longitudinal gate of the railcar coupled the second beam remains in a closed configuration when the first beam transitions from the first position to the second position, and applying a second air pressure level greater than the first air pressure level to the inlet port of the pneumatic cylinder, wherein:

applying the second air pressure level transitions the first beam from the second position to a third position, the first longitudinal gate remains in an at least partially open configuration when the first beam transitions from the second position to the third position, the second longitudinal gate transitions from the closed configuration to an at least partially open configuration when the first beam transitions from the second position to the third position.

12. The method of claim 11, wherein:

a first strut applies a compressive force to the first longitudinal gate when the first longitudinal gate is closed; and a second strut applies a compressive force to the second longitudinal gate when the second longitudinal gate is closed.

13. The method of claim 11, wherein transitioning the first beam from the first position to the second position comprises moving a beam pin of the second beam within a slot of an elongated link of the first beam.

14. The method of claim 11, wherein transitioning the first beam from the first position to the second position comprises moving a gate pin of the first longitudinal gate within a slot of an elongated link of a strut coupled to the first beam.

15. The method of claim 11, wherein transitioning the first beam from the second position to the third position comprises the first beam applying a force to the second beam sufficient to transition the second beam from a first position to a second position.

16. The method of claim 11, wherein the first beam is in contact with the second beam when the first beam is in the first position.

17. The method of claim 11, wherein a first strut is beyond the over center position when the first beam is in the second position.

18. The method of claim 11, further comprising waiting a predetermined amount of time between applying the first air pressure level and the second air pressure level.

19. A railcar system comprising:

a railcar comprising a first longitudinal gate and a second longitudinal gate;

a first beam configured to move longitudinally with respect to the railcar;

a second beam configured to move longitudinally with respect to the railcar;

a first strut comprising a first end and a second end, wherein:

the first end of the first strut is connected to the first longitudinal gate, and the second end of the first strut is connected to the first beam;

a second strut comprising a first end and a second end, wherein:

the first end of the second strut is connected to the second longitudinal gate, and the second end of the second strut is connected to the second beam;

a first pneumatic cylinder operably coupled to the first beam, wherein the first pneumatic cylinder is configured to move the first beam longitudinally with respect to the railcar;

a second pneumatic cylinder operably coupled to the second beam, wherein the second pneumatic cylinder is configured to move the second beam longitudinally with respect to the railcar;

a conduit configured to provide a flow path from an outlet port of the first pneumatic cylinder to an inlet port of the second pneumatic cylinder, wherein:

the first pneumatic cylinder is configured to transition the first beam from a first position to a second position in response to receiving a first air pressure level at an inlet port of the first pneumatic cylinder, wherein:

the first longitudinal gate and the second longitudinal gate are both closed when the first beam is in the first position, and the first longitudinal gate is at least partially open and the second longitudinal gate are closed when the first beam is in the second position;

the first pneumatic cylinder is configured to apply a force to a piston of the second pneumatic cylinder in response to receiving a second air pressure level greater than the first air pressure level at the inlet port of the first pneumatic cylinder, wherein:

applying the force to the piston of the second pneumatic cylinder transitions the second beam from a first position to a second position, and the first longitudinal gate and the second longitudinal gate are both at least partially open when the second beam is in the second position.

20. A longitudinal gate opening method comprising:

applying a first air pressure level to an inlet port of a first air cylinder disposed on a railcar, wherein:

applying the first air pressure level transitions a first beam from a first position to a second position, a first longitudinal gate coupled to the first beam transitions from a closed configuration to an at least partially open configuration when the first beam transitions from the first position to the second position, an outlet port of the first pneumatic cylinder is coupled to an inlet port of a second pneumatic cylinder using a conduit creating a flow path between the outlet port of the first pneumatic cylinder and the inlet port of the second pneumatic cylinder, the second cylinder is coupled to a second beam, and a second longitudinal gate of the railcar coupled to the second beam remains in a closed configuration when the first beam transitions from the first position to the second position;

applying a second air pressure level greater than the first air level pressure to the inlet port of the first pneumatic cylinder, wherein:

applying the second air pressure level transitions the second beam from a first position, the first longitudinal gate remains in an at least partially open configuration when the second beam transitions from the first position to the second position, and the second longitudinal gate transitions from the closed configuration to an at least partially open configuration when the second beam transitions from the first position to the second position.

* * * * *